US005997132A

United States Patent [19]

Smith et al.

[11] Patent Number: 5,997,132

[45] Date of Patent: Dec. 7, 1999

[54] METHOD AND APPARATUS FOR IMPROVING IMAGE QUALITY

[75] Inventors: Greg S. Smith, Carlsbad; Mark G. Wisnosky, Poway, both of Calif.

[73] Assignee: Hewlett-Packard Company, Palo Alto, Calif.

[21] Appl. No.: 08/735,037

[22] Filed: Oct. 22, 1996

[51] Int. Cl.[6] ..... B41J 2/21

[52] U.S. Cl. ..... 347/43

[58] Field of Search ..... 347/43, 15, 98

[56] References Cited

U.S. PATENT DOCUMENTS

| | | | |
|---|---|---|---|
| 4,413,275 | 11/1983 | Horiuchi et al. | 347/43 X |
| 4,494,128 | 1/1985 | Vaught | 347/98 |
| 4,538,160 | 8/1985 | Uchiyama | 347/98 X |
| 4,630,076 | 12/1986 | Yoshimura | 347/43 |
| 4,680,058 | 7/1987 | Shimizu et al. | 106/31.65 |
| 4,746,935 | 5/1988 | Allen | 347/98 |
| 4,908,712 | 3/1990 | Uchiyama et al. | 347/43 X |
| 4,952,942 | 8/1990 | Kanome et al. | 347/15 |
| 4,967,203 | 10/1990 | Doan et al. | 347/41 |
| 5,111,302 | 5/1992 | Chan et al. | 347/43 X |
| 5,635,969 | 6/1997 | Allen | 347/96 |

FOREIGN PATENT DOCUMENTS

| | | | |
|---|---|---|---|
| 0273664 | 7/1988 | European Pat. Off. | B41J 3/04 |
| 0539157 | 4/1993 | European Pat. Off. | B41J 2/21 |
| 0595650 | 5/1994 | European Pat. Off. | B41J 2/21 |
| 0684147 | 11/1995 | European Pat. Off. | B41M 7/00 |
| 59-162055 | 9/1984 | Japan | B41J 3/04 |
| 62-42847 | 2/1987 | Japan | 347/43 |

OTHER PUBLICATIONS

Patent Abstract of Japan vol. 010 No. 092 (M–468), Apr. 9, 1986 & JP 60 229757 A (Shinko Denki KK.), Nov. 15, 1985 *Abstract*.

*Primary Examiner*—John Barlow
*Assistant Examiner*—Michael Nghiem

[57] ABSTRACT

Achromatic Component Addition technique for producing printed ink-jet images of high quality, low granularity, and increased resolution of dithered gradients. Drops of chromatic inks are combined with drops of achromatic ink in any predetermined ratio and in any predetermined order on predetermined areas on a printing medium to produce imaged areas having differing lightness and lower chroma. The technique increases the number of color levels without increasing printer resolution and effectively increases resolution of dithered gradients by requiring fewer addressable pixels to produce the same color transition.

3 Claims, 9 Drawing Sheets

METHOD AND APPARATUS FOR IMPROVING IMAGE QUALITY

FIELD OF INVENTION

The present invention generally relates to methods and apparatus for ink-jet printing and, more particularly, to improving ink-jet image quality.

BACKGROUND OF INVENTION

The use of ink-jet printing systems has grown dramatically in recent years. This growth may be attributed to substantial improvements in print resolution and overall print quality coupled with appreciable reduction in cost. Today's ink-jet printers offer acceptable print quality for many commercial, business, and household applications at costs fully an order of magnitude lower than comparable products available just a few years ago.

An ink-jet image is formed when a precise pattern of dots is ejected from a drop generating device known as a "printhead" onto a printing medium. The typical ink-jet printhead has an array of precisely formed nozzles attached to a thermal ink-jet printhead substrate. The substrate incorporates an array of firing chambers that receive liquid ink (colorants dissolved or dispersed in a solvent) through fluid communication with one or more ink reservoirs. Each chamber has a thin-film resistor, known as a "firing resistor," located opposite the nozzle so ink can collect between the firing resistor and the nozzle. The printhead is held and protected by an outer packaging referred to as a print cartridge.

The print cartridge is mounted on a carriage that travels along the width of the printer. As the print medium and the print cartridge are positioned in the desired location in the printer, the appropriate resistor is electronically enabled. When electric printing pulses heat the thermal ink-jet firing resistor, a small volume of ink adjacent the firing resistor is heated, vaporizing a bubble of ink, and thereby ejecting a drop of ink from the printhead. The drops strike the printing medium and then dry to form "dots" that, when viewed together, form the printed image. A "pass" is completed once the carriage has spanned the entire width of the medium. A single image element (pixel) can receive one or more drops of ink during a single pass or multiple passes from the same or different nozzles. The number of passes depends on many factors such as the print application and choice of print medium. Examples of print application include graphics or text. Examples of different print media include plain paper, coated paper, glossy paper, or overhead projector transparency film.

Color ink-jet printers typically use only three inks of differing hues, magenta, yellow, and cyan, and optionally a fourth achromatic black ink. The magenta, yellow, and cyan colors are referred to as subtractive "primary colors." Other "secondary colors" can be generated using different combinations of the primary colors by ejecting drops of the primary colors using either or both dot-on-dot (DOD) and dot-next-to-dot (DND) methods. In the DOD method mixing of the primary colors occurs when the drops are placed on top of one another on the print medium. In the DND method the mixing of colors occurs at the side by side or DND interface boundaries. The ejection of multiple ink drops occuring either during the same pass or different passes is well known in the art. For example, the secondary colors of red, blue, and green can be obtained by combining the following colors, respectively: magenta and yellow, red and cyan, yellow and cyan. The number of color combinations produceable (color gamut or gamut volume) differs for different printing systems. The volume of the color space (gamut volume) and the surface of the color space (gamut surface) are affected by the choice of the imaging system components such as dyes and media, and the imaging technique such as inkjet and photography.

Any given perceived color can be described using any one of the well known color spaces, such as CIELAB and Munsell. For example, in the Munsell System a given color is defined using three terms, Hue, Value, and Chroma. Similarly, as illustrated in FIGS. 1 and 2, in the CIELAB color space, a color is defined using three terms L*, a*, and b* and additional terms such as C* (chroma) and h° (hue angle) are used to further describe a given color, wherein $$C^*_{ab}=(a^{*2}+b^{*2})^{1/2} \quad \text{equation 1}$$

$$h^\circ_{ab}=\tan^{-1}b^*/a^* \quad \text{equation 2}$$

One attribute detracting from the perceived quality of a printed image is undesirable granularity. Granularity refers to the non-uniformity and graininess of the image as perceived by the observer. Granularity is a function of both the dot size and contrast. Dot size refers to the size of an ink-jet droplet on the print medium and contrast refers to the measure of difference between two lightness levels—see graylevel, below. The smaller the dot size, the lower the granularity. The lower the contrast between two dots or between the dot and the white of the printed page, the lower the granularity.

In order to decrease granularity and to print sharper and more definite images, either or both the printer resolution and the image graylevel must be increased. Printer resolution is generally referred to as the number of dots per inch (dpi) the printer is capable of producing. Graylevel (or levels of gray) basically signifies the range of perceived lightness between black and white. Although the term graylevel originated for describing gray produced via black-only (achromatic) printing, it is also used to denote the equivalent in color printing (levels of color). The terms color level, levels of color, and color graylevel, all describe colors produced via color printing where the resulting colors having the same hue differ in either or both their Munsell Value and Munsell Chroma. Thus, here, the term graylevel is understood to refer to both levels of gray in black and white printing and levels of color in color printing. Graylevel can be increased through the use of dithering techniques in binary printers or depositing more than one level of lightness (or level of color) in gray level printers, as described below.

The drop on demand system and most of the continuous ink-jet printing systems are essentially binary, i.e., at each image element (pixel) of the paper there must be placed a droplet of ink or no ink at all, thus the term binary. The color white is produced by the paper itself. This binary performance limits the range of colors that can be produced with an ink-jet printer since a binary printing system cannot produce graylevels (or color levels) using only one pixel.

Well known dithering techniques in which the image is divided into very small square matrices (also referred to as "super pixels") have been used to increase the number of graylevels in a binary printer. Each matrix contains a certain number of pixels, such as 2×2 or 4×4 pixels. To produce the perception of gray, the black is applied spatially extending in two dimensions in differing quantities. This method is called halftoning and the resulting perception that grays are produced is called graylevels and is explained in U.S. Pat. No. 4,967,203 entitled "Interlace Printing Process" by Doan.

The term graylevel can also be used to indicate the ability of a printer (a graylevel printer) to deposit, unlike a binary printer, more than one level of lightness (or level of color) at a single pixel site. This differs from the use of the same term employed above for binary printers which require more than one pixel site to produce graylevels.

Different techniques utilizing graylevel printers have been used to increase color levels. One approach to varying color levels is to provide different colorant concentrations of an ink of a given hue. These different inks can be stored in separate ink-jet print cartridges, each with a separate ink reservoir; in different ink reservoir, within the same ink-jet print cartridge; or separate off-board ink reservoirs where the ink-jet print cartridges do not have self-contained ink reservoirs. However, these approaches require a number of ink reservoirs or print cartridges and thus require expensive, complex systems.

Another approach to varying graylevel is described in U.S. Pat. No. 4,494,128 entitled "Gray Scale Printing with Ink Jets" by Vaught. Vaught discloses a valving apparatus in a thermal ink-jet system for mixing clear ink vehicle (diluent) with the colored ink during the actual jet printing process to produce variation in visual print density (graylevel). Adapting such a system for color mixing in the firing chamber is suggested. Such techniques also require more expensive, and complex systems.

The use of white ink in some special applications has been described in patents such as U.S. Pat. No. 4,680,058 entitled "White Ink Compositions for Ink-Jet Printing" by Shimizu. The Shimizu patent, however, is limited to the use of white ink as an independent ink for printing on colored or dark print media.

Notwithstanding their recent success, intensive research and development efforts continue toward improving ink-jet print quality. In general, ink-jet print quality still falls short of that produced by more expensive technologies such as photography and offset or gravure printing. A surge in interest in ink-jet imaging (e.g., the rendition of pictures) has resulted in the need to produce near photographic quality printed images at a reasonable cost. The challenge remains to further improve the quality of ink-jet printed images without increasing their cost.

It will be apparent from the foregoing that although there are many processes and apparatus for improving the print quality of an ink-jet image, there is still a need for an approach that provides a cost effective and adaptable process for improving image quality without increasing printer resolution or relying on expensive and complicated apparatus.

SUMMARY OF THE INVENTION

Briefly and in general terms, a method for enhancing the quality of printed ink-jet images, includes providing an achromatic ink, providing a chromatic ink, selecting a predetermined area on a printing medium, selecting a predetermined sequence for depositing said achromatic and said chromatic inks, depositing at least one drop of said achromatic ink onto the predetermined area, and depositing at least one drop of said chromatic ink onto the predetermined area such that the deposited ink drops on the predetermined area at least partially overlay one another.

A method for improving ink-jet image quality, includes the steps of providing an achromatic ink, providing a chromatic ink, selecting predetermined areas on a printing medium in a predetermined manner, selecting a predetermined sequence for both depositing and not depositing said achromatic and said chromatic inks on the areas, depositing drops of said achromatic ink and said chromatic ink onto the predetermined areas in accordance with the predetermined sequence, and depositing said drops of said inks onto the predetermined area such that where an area has deposited thereon both a drop of achromatic ink and a drop of chromatic ink the drops at least partially overlay one another.

An ink-jet printing apparatus, includes a first ink reservoir containing an achromatic ink; a second ink reservoir containing a chromatic ink, means for ejecting overlying drops of said achromatic and said chromatic inks onto a predetermined area on a printing medium, said drop ejecting means in fluid communication with said first and said second ink reservoirs; a nozzle in fluid communication with said drop ejecting means for depositing drops of said achromatic and said chromatic inks on the predetermined area, wherein the deposited drops of said achromatic and said chromatic inks on the predetermined area are at least partially overlaid.

An apparatus for an ink-jet printing system, includes a print cartridge having five ink reservoirs for housing white, black, cyan, magenta, and yellow inks respectively; means for ejecting overlying drops of ink onto a predetermined area of a printing medium, said drop ejecting means in fluid communication with said five ink reservoirs; a plurality of nozzles in fluid communication with said drop ejecting means for depositing drops of said white, black, cyan, magenta, and yellow inks on the predetermined area.

An ink-jet printing medium having an image printed thereon of improved quality, includes a printing medium having predetermined areas whereon a plurality of drops of achromatic and chromatic inks have been deposited, the drops of said achromatic and said chromatic inks on each predetermined area are at least partially overlaid.

Achromatic Component Addition, ACA, as presented here, is used (a) to produce printed inkjet images of high quality and low granularity by increasing the number of color levels without increasing printer resolution, i.e., dpi, and (b) to effectively increase resolution of dithered gradients by requiring fewer addressable pixels to produce the same color transition from chromatic to achromatic.

The present invention uses the same or similar print cartridge designs as those used in existing ink-jet printing systems. This use of the present invention with existing print cartridges minimizes the cost associated with designing new print cartridges.

The invention approaches the problem of printed image granularity from the perspective that dots of lower contrast, relative to the media on which they are printed, are more difficult for the naked eye to discern, therefore, producing a higher quality image.

Application of ACA to full chroma primary and secondary colors can produce greater than three color graylevels for each of cyan, magenta, yellow, red, green, and blue; as well as one or two color graylevels for composite black. Composite black is a tertiary color which is produced when all three primary colors are combined to generate black.

It will be apparent from the foregoing that the present invention provides a useful and cost effective solution to increasing quality of an ink-jet printed image.

BRIEF DESCRIPTION OF THE DRAWINGS

FIG. 8(*b*) illustrates the direction of color movement in the CIELAB color space for the data presented in FIG. 8(*a*).

FIG. 9(*b*) illustrates the direction of color movement in the CIELAB color space for the data presented in FIG. 9(*a*).

FIG. 10(*b*) illustrates the transition of the cyan image of FIG. 10(*a*) to the white color of the paper using the Achromatic Component Addition technique.

FIG. 11(*b*) illustrates the transition of the cyan image of FIG. 11(*a*) to the white color of the paper using Achromatic Component Addition technique.

FIG. 12(*b*) illustrates the use of Achromatic Component Addition technique to increase the number of color levels of the super pixel of FIG. 12(*a*).

DESCRIPTION OF THE PREFERRED EMBODIMENT

Figure 1:
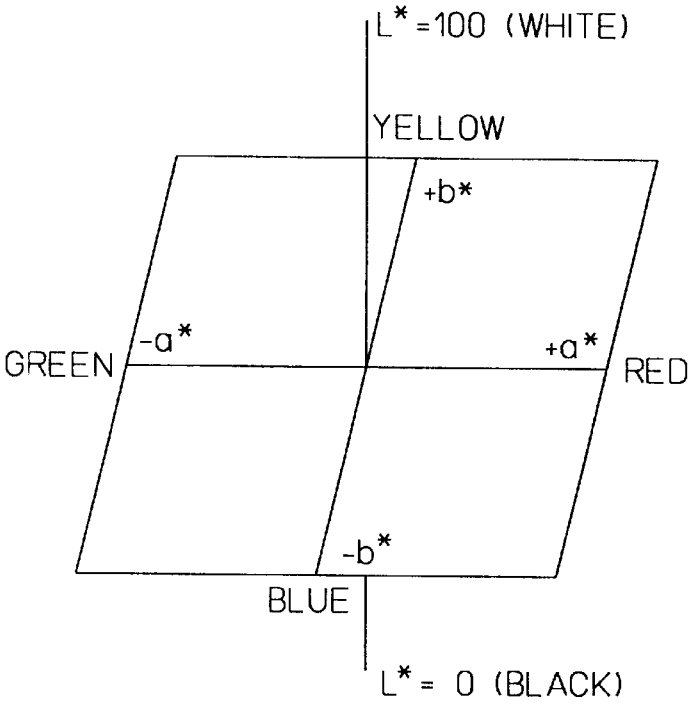
Figure 1 (PRIOR ART)
FIG. 1 is an illustration of the CIELAB color space.
Figure 2:
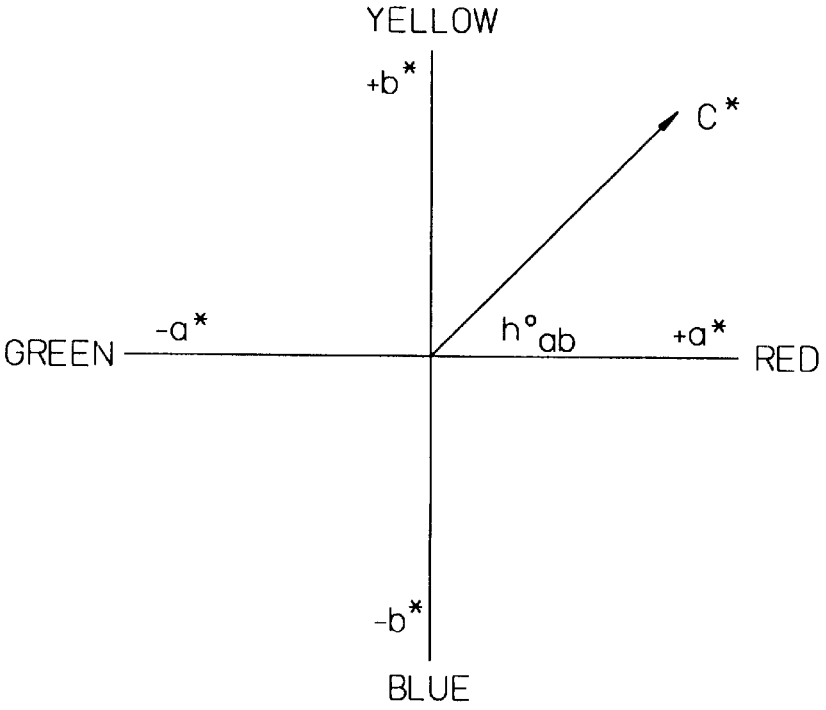
Figure 2 (PRIOR ART)
FIG. 2 is an illustration of the CIELAB color space of FIG. 1 projected onto a plane of constant lightness.
Figure 3:
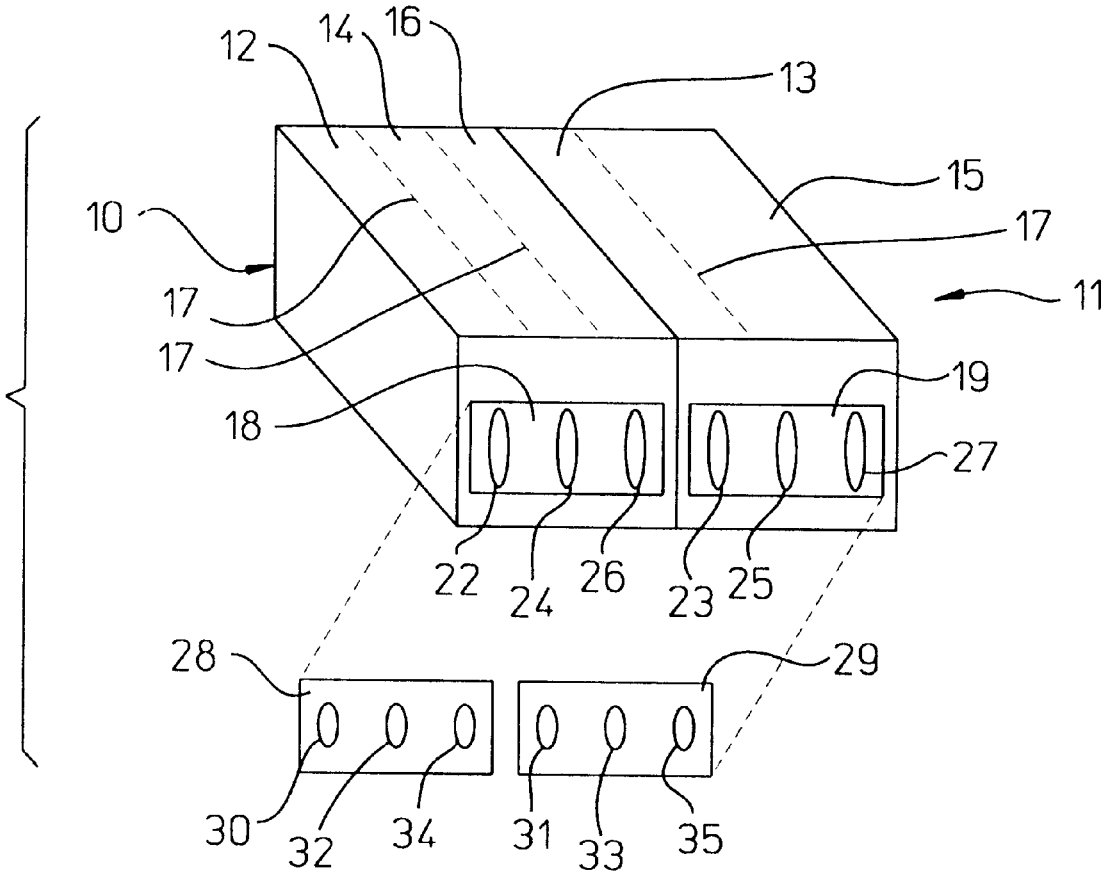
FIG. 3 is an isometric view of both a tri-chamber and a dual chamber print cartridge.

Referring to FIG. 3, reference numeral 10 generally indicates a print cartridge of conventional thermal ink-jet construction and operation such as Print Cartridge Model Number 51625A available from the Hewlett-Packard Company of Palo Alto, Calif. The print cartridge 10 has three ink reservoirs 12, 14, and 16 for housing cyan, magenta, and yellow inks, respectively. The ink reservoirs, 12, 14, and 16, are divided by partitions 17, within the interior of the print cartridge 10. The partitions 17 are illustrated as dashed lines in FIG. 3. The inks in ink reservoirs 12. 14, and 16 are in fluid communication with three sets of nozzles, 30, 32, and 34 located on a printhead 28, respectively, FIG. 4, through ink outlet ports 22, 24, and 26 located on a rectangular support receptacle 18, FIG. 3.

Further referring to FIG. 3, reference numeral 11 generally indicates a print cartridge having two ink reservoirs 13 and 15 for housing achromatic black and white inks, respectively. The ink reservoirs, 13 and 15, are divided by partition 17, within the interior of the print cartridge 11. The ink in ink reservoir 13 is in fluid communication with a set of nozzles 31 located on a printhead 29, FIG. 4, through ink outlet port 23, located on a rectangular support receptacle 19, FIG. 3. The ink in ink reservoir 15 is in fluid communication with two sets of nozzles, 33 and 35, located on the printhead 29, FIG. 4, through ink outlet ports 25 and 27, located on the rectangular support receptacle 19, FIG. 3.

Figure 4:
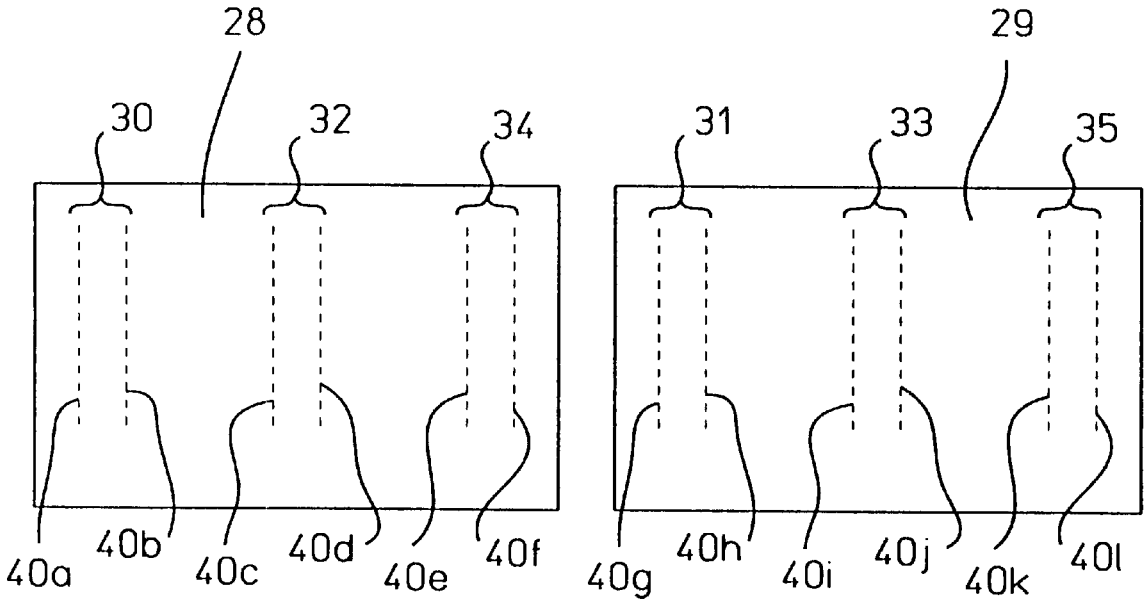
FIG. 4 is a front elevational view of the nozzle configuration of the print cartridges of FIG. 3.
Figure 5:
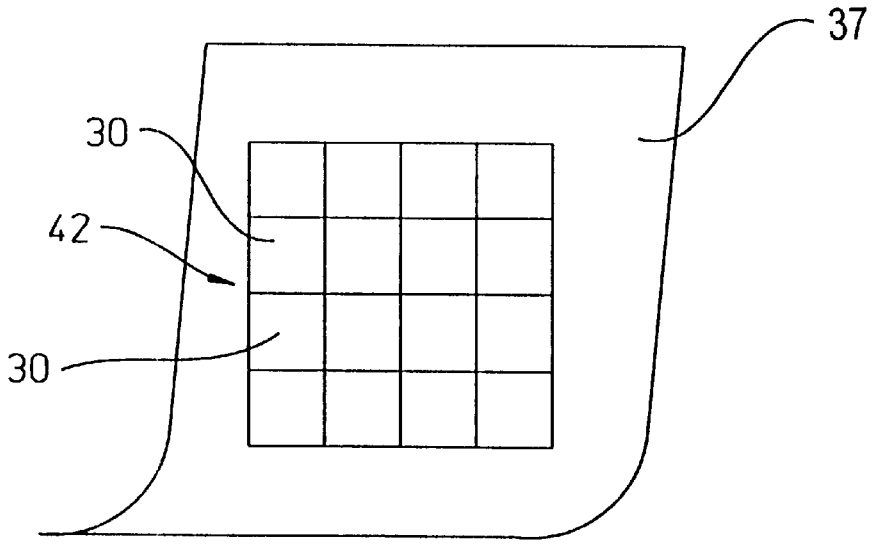
FIG. 5 represents a predetermined area on a print medium made up of a plurality of pixels.
Figure 6A:
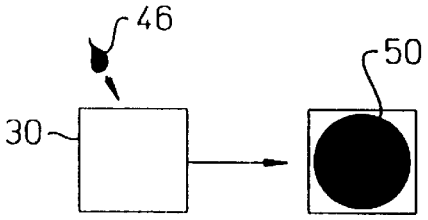
FIGS. 6(*a*) through 6(*d*) are diagrammatic views of a printing scheme to increase the number of color levels.
Figure 6B:
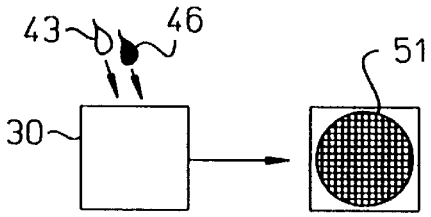
Figure 6C:
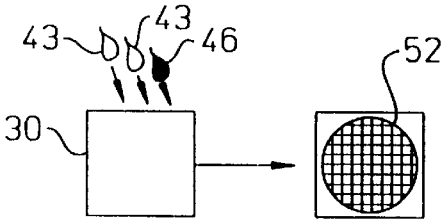
Figure 6D:
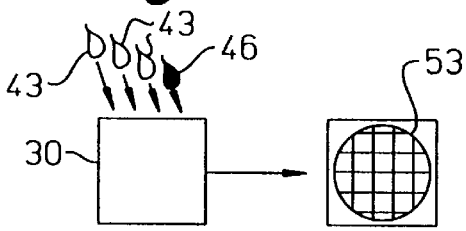
Figure 7A:
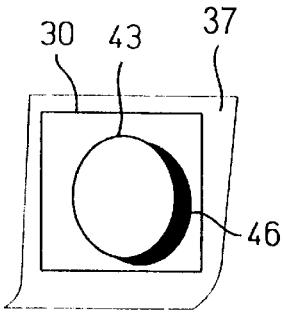
FIGS. 7(*a*) through 7(*d*) illustrate other printing schemes for increasing the number of color levels.
Figure 7B:
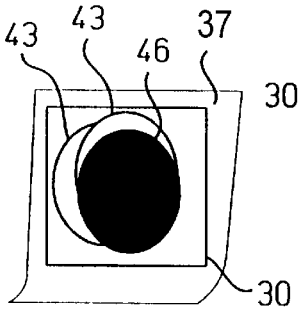
Figure 7C:
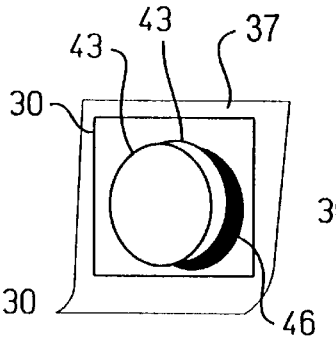
Figure 7D:
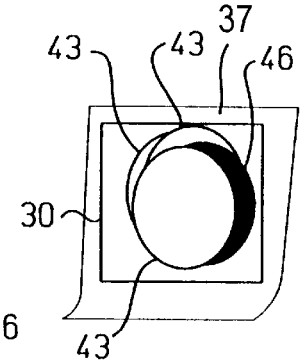

As illustrated in FIG. 4, the nozzle sets 30, 32, and 34 on printhead 28, and nozzle sets 31, 33, and 35 on printhead 29, each comprises a plurality of nozzles through which ink travels from ink reservoirs 12, 14, 16; and 13 and 15, respectively, onto a print medium such as paper 37, FIG. 5. Each nozzle set on printheads 28 and 29, FIG. 4, is arranged in two sets of parallel vertical columns: 40*a* through 40*f*, and 40*g* though 40*j*, respectively. The column pairs 40*a* and 40*b*; 40*c* and 40*d*; 40*e* and 40*f*, 40*g* and 40*h*; and two column pairs 40*i* and 40*j*, and 40*k* and 40*l*; are the print nozzles associated with cyan, magenta, yellow, white, and black inks, respectively. The number of nozzles in each column is a matter of design.

The chromatic inks, cyan, yellow, and magenta, and any combinations thereof, can be overlaid with either, both or none of the achromatic inks, black and white, on a predetermined area 42 comprising of a plurality of pixels 30 on paper 37, FIG. 5. The drops can also be partially or fully overlaid. The sequence of ink drop deposit and the order of ink drop overlay is a matter of design. The drops of ink can be ejected during the same or different passes of the print cartridges 10 and 11 across the paper 37.

FIGS. 6(*a*) through 6(*d*) illustrate a printing scheme of depositing one drop of cyan ink 46 from printhead 28, and zero to three drops of white ink 43 from printhead 29, onto the same pixel 30 thereby forming imaged areas having different color graylevels. FIG. 6(*a*) illustrates a drop of cyan ink 46 being deposited onto pixel 30 thereby forming an imaged area 50, having a saturated cyan color. FIGS. 6(*b*), 6(*c*), and 6(*d*), illustrate the same pixel 30 receiving the same cyan ink drop 46 followed by one to three drops of white ink 43, thereby forming imaged areas 51, 52, and 53, respectively. Each additional drop of white ink 43 deposited onto pixel 30 results in imaged areas having altered colors of progressively higher lightness and lower chroma, as illustrated by the decreasing density of the imaged areas, 51, 52, and 53.

It should be noted that the representation of the placement and relative size of the dots with respect to pixel 30 in FIGS. 6(*a*) though 6(*d*) and all other figures to follow, is not intended to be exact and that these figures are for illustration purposes only. It should also be noted that in order to better illustrate the invention, in FIGS. 6(*a*) through 6(*d*) and all figures to follow, the color alteration of the colored pixels is illustrated by varying the density of the colored area.

FIGS. 7(*a*) through 7(*d*) illustrate other printing schemes with respect to the order of ink drops deposited onto pixel 30. The choice of the number of white ink drops 43 and the order of ink deposit is a matter of design. FIG. 7(*a*) illustrates a drop of cyan ink 46 deposited onto pixel 30 followed by a drop of white ink 43 thereby forming an imaged area 60. FIGS. 7(b), 7(*c*), and 7(*d*), illustrate the same pixel 30 having received two drops of white ink 43 followed by a drop of cyan ink 46; a drop of cyan ink 46 followed by two drops of white ink 43; and two drops of white ink 43 followed by a drop of cyan ink 46 and a drop of white ink 43; thereby forming imaged areas 61, 62, and 63, respectively. It should be noted that in FIGS. 7(*a*) through 7(*d*) the ink drops as illustrated are displaced with respect to each other to better illustrate the sequence of drop deposition.

Table 1 illustrates an example of color graylevels obtainable when using Achromatic Component Addition. The example in Table 1 uses a printing system having a print resolution of 300 dots per inch, each drop of ink having a volume of 40 pico liters, pl, and the paper 37 being capable of absorbing 200 pl of ink per pixel 30. The first color exemplified is cyan, as indicated in the column labeled "Cyan". A minimum of 1 drop of cyan ink, with a volume of 40 pl, is necessary to form the saturated primary color of cyan on pixel 30, Table 1, rows 1–3. One to four drops of white ink, each having a volume of 40 pl, can be deposited onto the same pixel 30 resulting in cumulative volumes of: 80 pl (40 pl cyan+40 pl white), Table 1, rows 4–6; 120 pl (40 pl cyan+2×40 pl white), Table 1, rows 7–9; 160 pl (40 pl cyan+3×40 pl white), Table 1, rows 10–12; and 200 pl (40 pl cyan+4×40 pl white), Table 1, rows 13–15; respectively. The first drop of cyan ink creates one color graylevel. The addition of each drop of white ink creates one additional color graylevel, for a total of five color graylevels, Table 1, row 16.

TABLE 1

Number of Color Graylevels Obtainable Using Acpromatic Component Addition

| Row# | | Cyan (C) | Magenta (M) | Yellow (Y) | Red (R) | Green (G) | Blue (B) | Composite Black (Kc) |
|---|---|---|---|---|---|---|---|---|
| 1 | | | Saturated Primary Color | | | Saturated Secondary Color | | Saturated Tertiary Color |
| 2 | Minimum drops for Saturated Color | 1C | 1M | 1Y | 1M + 1Y | 1C + 1Y | 1C + 1M | 1C + 1M + 1Y |
| 3 | Ink Volume (pl) | 40 | 40 | 40 | 80 | 80 | 80 | 120 |
| 4 | First Drop of White Ink | | First Altered Color | | | First Altered Color | | First Altered Color |
| 5 | White Ink Volume (pl) | 40 | 40 | 40 | 40 | 40 | 40 | 40 |
| 6 | Cumulative Volume (pl) | 80 | 80 | 80 | 120 | 120 | 120 | 160 |
| 7 | Second Drop of White Ink | | Second Altered Color | | | Second Altered Color | | Second Altered Color |
| 8 | White Ink Volume (pl) | 40 | 40 | 40 | 40 | 40 | 40 | 40 |
| 9 | Cumulative Volume (pl) | 120 | 120 | 120 | 160 | 160 | 160 | 200 |
| 10 | Third Drop of White Ink | | Third Altered Color | | | Third Altered Color | | |
| 11 | White Ink Volume (pl) | 40 | 40 | 40 | 40 | 40 | 40 | |
| 12 | Cumulative Volume (pl) | 160 | 160 | 160 | 200 | 200 | 200 | |
| 13 | Fourth Drop of White Ink | | Fourth Altered Color | | | | | |
| 14 | White Ink Volume (pl) | 40 | 40 | 40 | | | | |
| 15 | Cumulative Volume (pl) | 200 | 200 | 200 | | | | |
| 16 | Color Graylevels | 5 | 5 | 5 | 4 | 4 | 4 | 3 |

The next two columns in Table 1 represent the same scenario for the other two primary colors, namely, magenta and yellow, respectively. The next three columns, as indicated by their column headings, represent the application of ACA to the secondary colors of red, green, and blue, respectively. As can be noted, each of the secondary saturated colors starts with 80 pl of ink. Thus, in order to maintain the total volume of ink deposited on pixel 30 to 200 pl, the total number of white drops 43 is limited to three leading to a total of four color levels, Table 1, row 16. The tertiary color of composite black starts with 120 pl. This starting ink volume limits the number of white ink drops 43 to two leading to a total of three color levels, Table 1, row 16.

Table 2 represents actual measurements taken on an area, such as area 42 on paper 37, FIG. 5, when a combination of magenta ink drops and white ink drops were ejected onto the area 42. The size of the area 42 was chosen to be sufficiently large to allow making color measurements using a MacBeth Color Eye 7000, made by the MacBeth Division of Kollmorgen Instruments Corporation of New York, using standard color measurement procedures. The paper used was HEWLETT-PACKARD Premium InkJet Paper, part number 51634Y, available from the Hewlett-Packard Company of Palo Alto, Calif.

TABLE 2

Measurements for Achromatic Component Addition of Magenta and White Inks

| Row # | Color and Number of Ink Drops M = magenta W = white | total drop volume (pl) | a* | b* | h° | L* | C* |
|---|---|---|---|---|---|---|---|
| 1 | 1M | 100 = 100 | 48 | −24 | 333 | 74 | 54 |
| 2 | 4W + 1M | 4 × 50 + 100 = | 42 | −22 | 333 | 76 | 47 |

TABLE 2-continued

Measurements for Achromatic Component Addition of Magenta and White Inks

| Row # | Color and Number of Ink Drops M = magenta W = white | total drop volume (pl) | a* | b* | h° | L* | C* |
|---|---|---|---|---|---|---|---|
| | | 300 | | | | | |
| 3 | 4W + 1M + 1W | 4 × 50 + 100 + 1 × 50 = 350 | 41 | −21 | 333 | 76 | 46 |
| 4 | 4W + 1M + 2W | 4 × 50 + 100 + 2 × 50 = 400 | 35 | −19 | 332 | 79 | 40 |
| 5 | 4W + IM + 3W | 4 × 50 + 100 + 3 × 50 = 450 | 35 | −19 | 332 | 79 | 40 |
| 6 | 4W + IM + 4W | 4 × 50 + 100 + 4 × 50 = 500 | 33 | −18 | 331 | 80 | 38 |

The first row depicts a scenario where only magenta ink was ejected onto each pixel 30 in area 42. Rows 2 through 6, each started with four drops of white ink followed by one drop of magenta; and zero to four drops of white ink onto each pixel 30 in area 42, respectively. As can be noted from the data in the C* and L* columns, addition of white ink drops decreased the chroma and increased the lightness of the area 42. As can be noted, all the rows have a hue angle, h°, of approximately 330 corresponding to magenta.

Figure 8A:
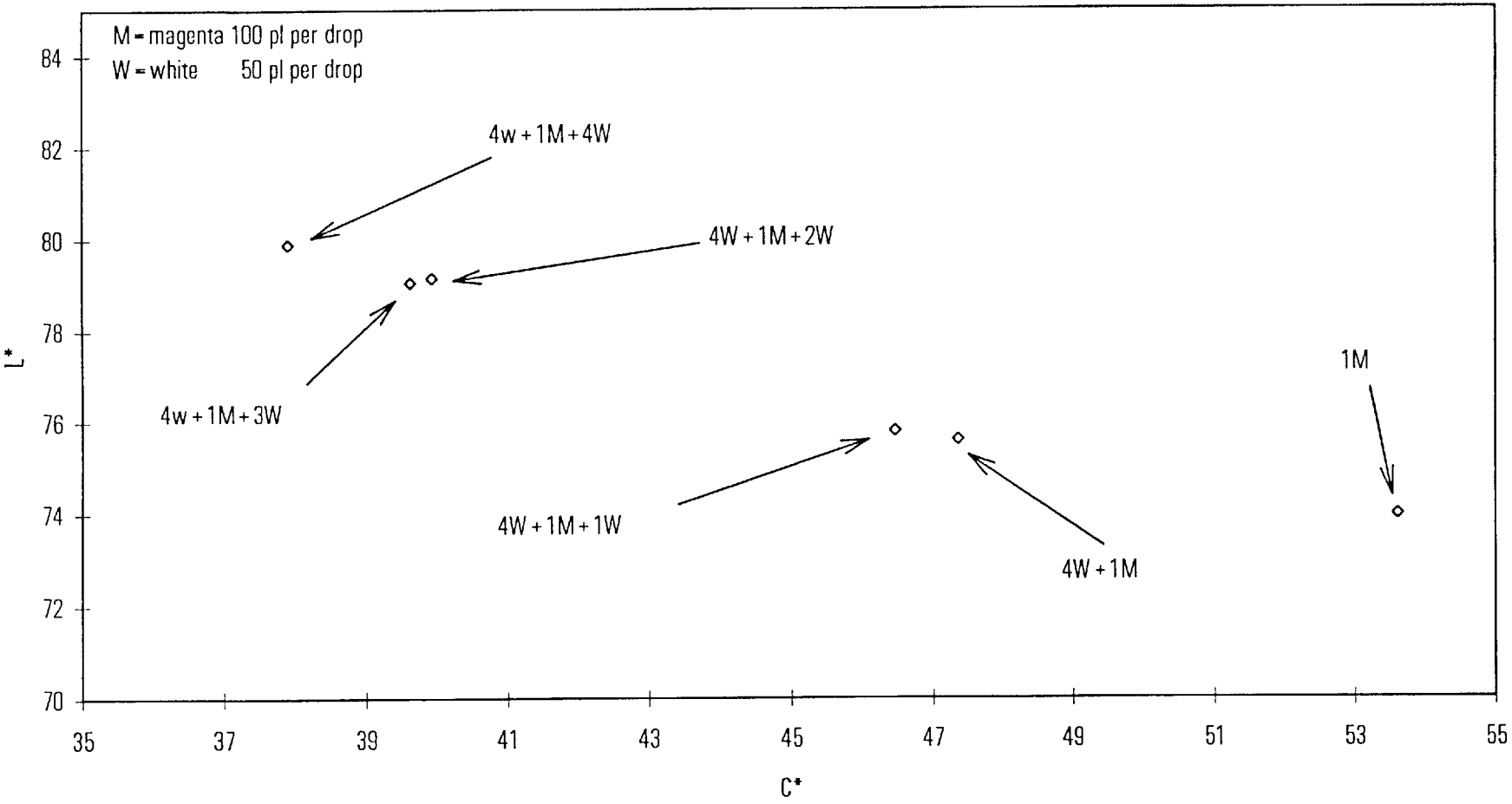
FIG. 8(*a*) is a graphical representation of data, in Table 2, obtained when using Achromatic Component Addition with magenta and white inks.
Figure 8B:
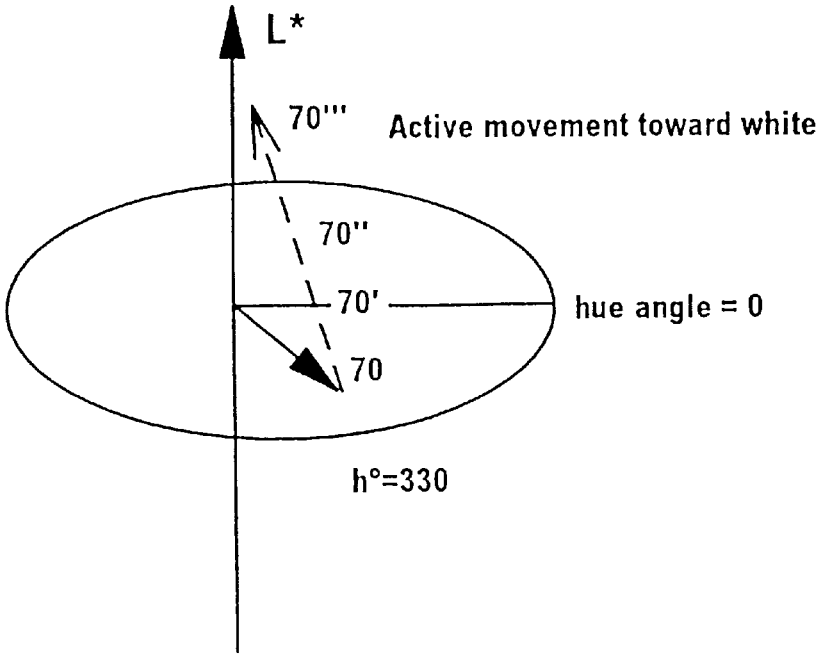

FIG. 8(*a*) provides a graphical illustration of the data presented in Table 2. As can be noted, the addition of white ink drops affected the chroma and lightness; of the area 42.

FIG. 8(*b*) illustrates the general direction of color movement for the data presented in Table 2. Reference numerals

70, 70', 70", and 70'" correspond to the progressively altered color of area 42 after receiving drops of either or both magenta and white inks. As can be noted, the color of area 42 moved from a chromatic magenta toward white by a simultaneous decrease in chroma and increase in lightness. This movement is represented by the change from point 70 to 70'".

Table 3 represents actual measurements taken on an area, such as area 42 on paper 37, FIG. 5, when a combination of cyan ink drops and black ink drops were ejected onto the area 42. Color measurements were then taken using the same instrument and procedure described above. The paper used was the same as that for Table 2.

TABLE 3

Measurements for Achromatic Component Addition of Cyan and Black Inks

| Row # | Color and Number of Ink Drops C = cyan K = black | total drop volume (pl) | a* | b* | h° | L* | C* |
|---|---|---|---|---|---|---|---|
| 1 | 1C | 70 = 70 | −21 | −25 | 231 | 82 | 32 |
| 2 | 3K + 1C | 3 × 50 + 70 = 220 | −8 | −12 | 236 | 48 | 14 |
| 3 | 3K + 1C + 1K | 3 × 50 + 70 + 50 = 270 | −6 | −10 | 241 | 45 | 12 |
| 4 | 3K + 1C + 2K | 3 × 50 + 70 + 2 × 50 = 320 | −5 | −10 | 243 | 43 | 11 |
| 5 | 3K + 1C + 3K | 3 × 50 + 70 + 3 × 50 = 370 | −4 | −9 | 244 | 42 | 10 |
| 6 | 3K + 1C + 4K | 3 × 50 + 70 + 4 × 50 = 420 | −5 | −9 | 243 | 42 | 11 |
| 7 | 3K + 1C + 5K | 3 × 50 + 70 + 5 × 50 = 470 | −4 | −9 | 244 | 41 | 10 |
| 8 | 3K + 1C + 6K | 3 × 50 + 70 + 6 × 50 = 520 | −4 | −9 | 244 | 41 | 10 |

The first row depicts a scenario where only cyan ink was ejected onto each pixel 30 in area 42. Rows 2 through 8, each started with three drops of black ink followed by one drop of cyan; and then zero to six drops of black ink onto each pixel 30 in area 42, respectively. As can be noted from the data in the C* and L* columns, addition of black ink drops decreased the chroma and decreased the lightness of the area 42. As can be noted, all the rows have a hue angle, h°, of approximately 230 corresponding to cyan.

Figure 9B:
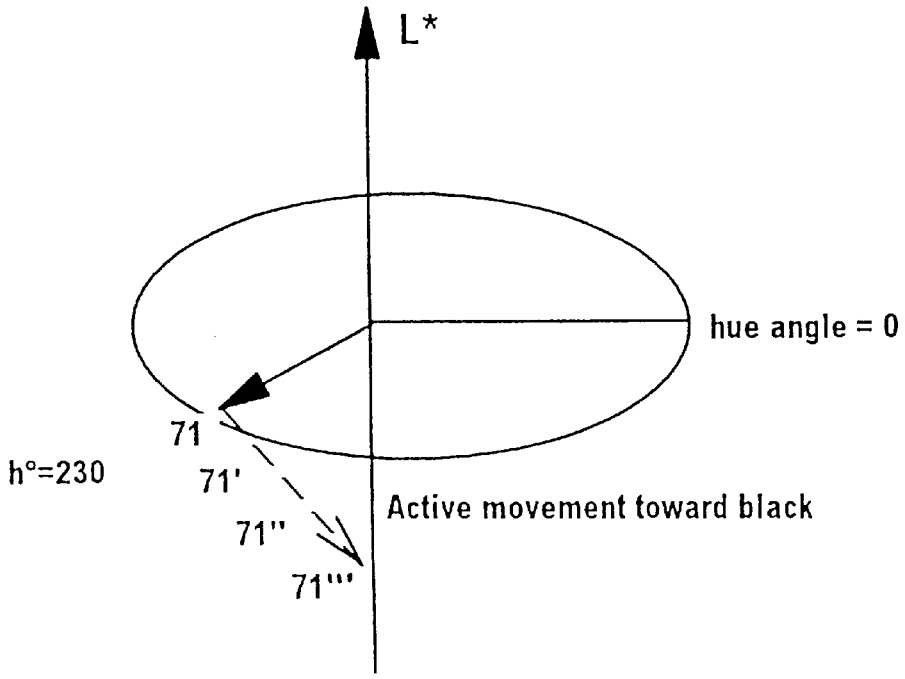
FIG. 9(*a*) is a graphical representation of data, in Table 3, when using Achromatic Component Addition with cyan and black inks.
Figure 9A:
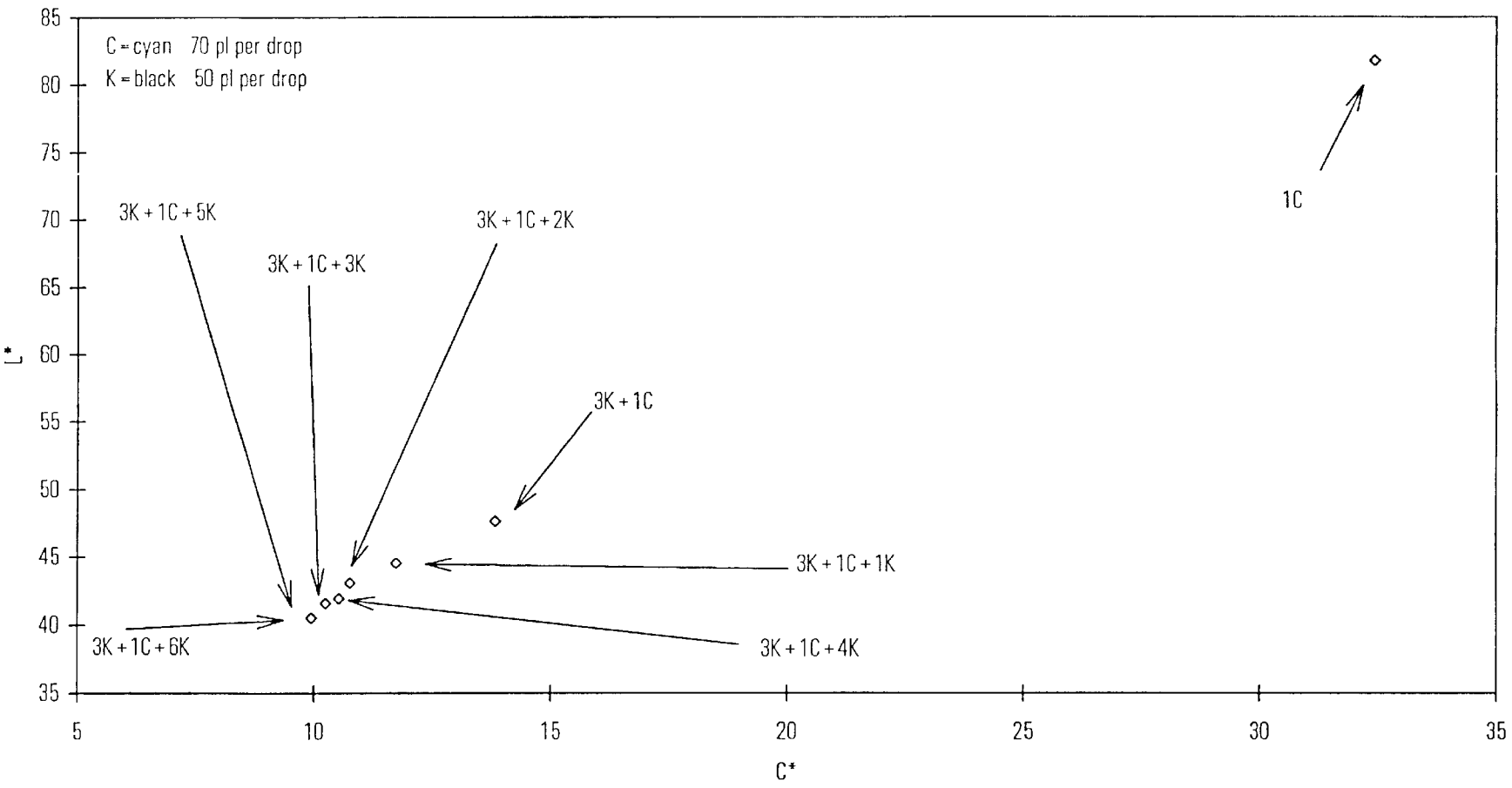

FIG. 9(*a*) provides a graphical illustration of the data represented in Table 3. As can be noted, the addition of black ink drops affected the chroma and lightness of the area 42.

FIG. 9(*b*) illustrates the general direction of color movement for the data presented in Table 3. Reference numerals 71, 71', 71", and 71'" correspond to the progressively altered color of area 42 after receiving drops of either or both cyan and black inks. As can be noted, the color of area 42 moved from a chromatic cyan toward black by a simultaneous decrease in chroma and decrease in lightness. This movement is represented by the change from point 71 to 71'".

Figure 10A:
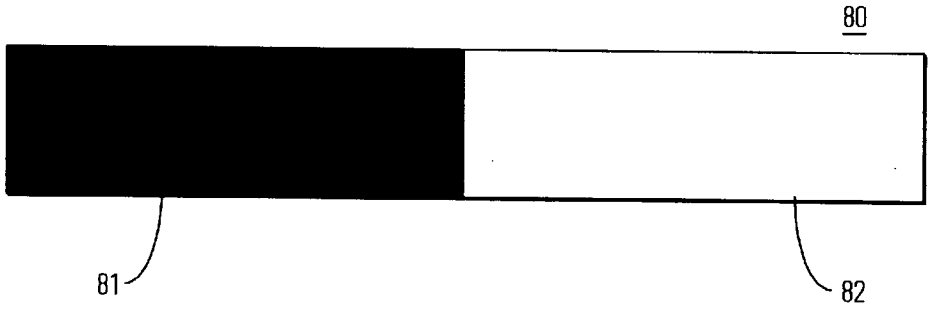
FIG. 10(*a*) illustrates the binary transition of a cyan image to the white color of the paper.
Figure 10B:
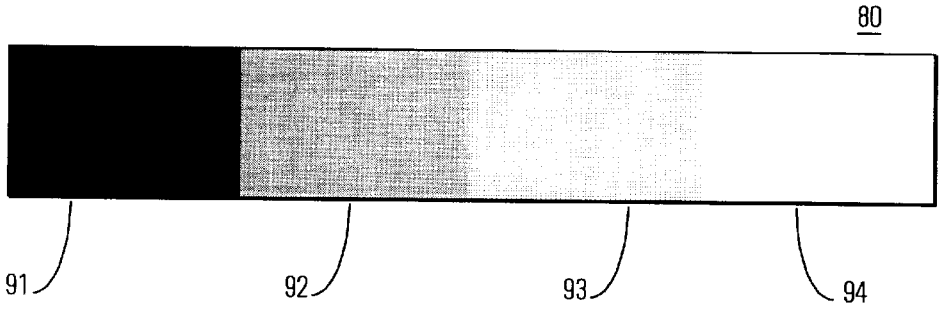

FIGS. 10(*a*) and 10(*b*) illustrate the improvement in graylevel when the simplest image gradient of a primary color, such as cyan, transitions to the white of the paper, FIG. 10(*a*), is combined with Achromatic Component Addition, FIG. 10(*b*), to produce a much smoother transition for the same arbitrary area shown in FIG. 10(*a*). FIG. 10(*a*) illustrates the gradient of a primary color cyan 81 transitioning to the white of the paper 82 for an arbitrary area 80. FIG. 10(*b*) illustrates a transition from cyan 91, through altered colors 92 and 93, to the white of the paper 94, for the same arbitrary area 80. As can be noted, the shift from cyan to white in FIG. 10(*a*) is binary and very obvious to the eye whereas the transition in FIG. 10(*b*) provides a smoother transition from cyan to white.

Figure 11A:
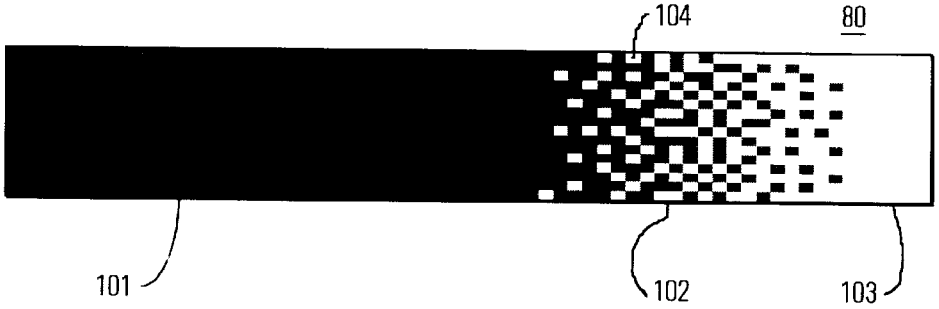
FIG. 11(*a*) illustrates the transition of a cyan image to the white color of the paper using a dithering technique.
Figure 11B:
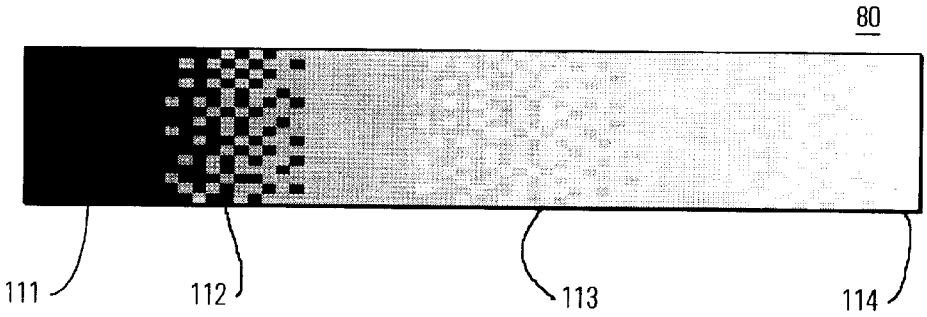

FIG. 11(*a*) illustrates a transition from cyan 101 to white of the paper 103 for the arbitrary area 80, using dithering of color dots in area 102. The use of dithering smoothes the transition from cyan 101 to white of the paper 103 as the color goes through dithered area 102. Each square 104 represents a single, addressable pixel.

FIG. 11(*b*) illustrates the application of dithering and Achromatic Component Addition techniques together to the same arbitrary area 80 shown in FIG. 11(*a*), to produce the smoothest transition of all. The use of dithering in combination with ACA improves the transition of cyan 111 to the white of the paper 114 as the color goes through areas 112 and 113.

Figure 12A:
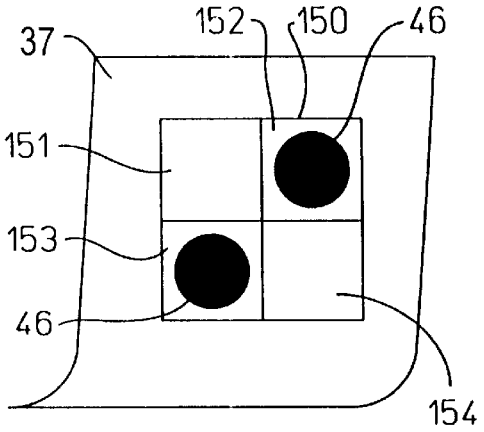
FIG. 12(*a*) illustrates the use of a halftoning technique to increase the number of perceived color levels in a super pixel.
Figure 12B:
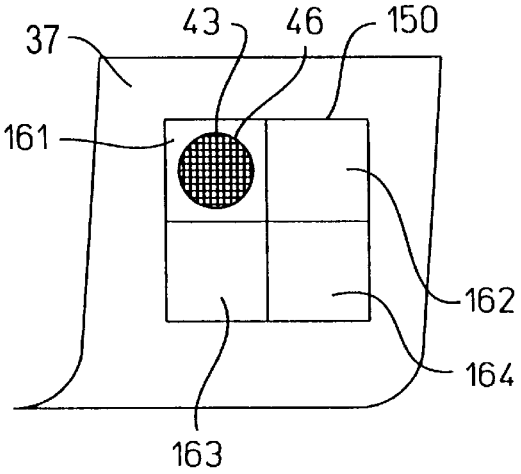

FIGS. 12(*a*) and 12(*b*) illustrate the use of Achromatic Component Addition to effectively increase the resolution of dithered gradients since fewer addressable pixels are required to produce the same color graylevels. As described above, in a binary printing system using dithering or halftoning methods in order to increase the number of graylevels, the picture is divided into very small square matrices (also referred to as "super pixels"). Here, as illustrated in FIG. 12(*a*), the super pixel 150 comprises a 2×2 matrix of pixels 151, 152, 153, and 154. To produce the perception of color level, the color is applied in two spatial dimensions. Two cyan drops 46 deposited in pixels 152 and 153 are used with two white pixels 151 and 154 from the paper to synthesize a perceived 50% cyan block. As a result, three perceived color levels for the printed image can be created: saturated or unaltered cyan, white, and the perceived 50% cyan.

As illustrated in FIG. 12(*b*), Achromatic Component Addition of cyan 46 and white 43 can produce the same number of color graylevels by actually producing a true 50% cyan dot. Here, only a single pixel 161 in super pixel 150 is used, thereby leaving the other three pixels, 162, 163, and 164, available for use by the printing system. The size of the pixels and the super pixel are a matter of design.

Figure 13:
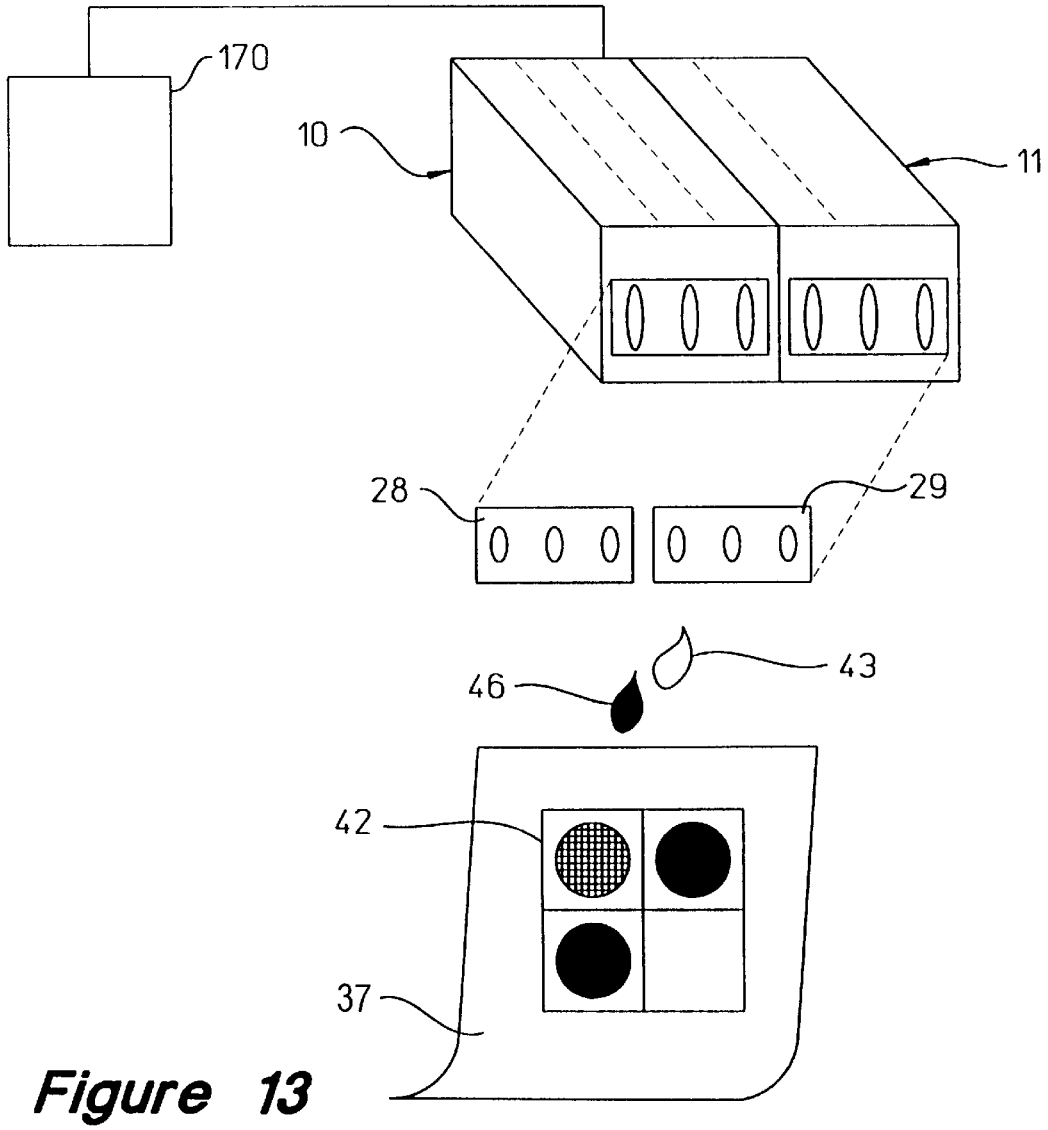
FIG. 13 illustrates an apparatus for producing the image of FIG. 12(1).

Referring to FIG. 13, reference numeral 170 generally indicates a well known computer/processor control for composing images comprising dithered patterns. The processor control 170 is combined with print cartridges 10 and 11 to create images such as that of FIG. 12(*b*). The improved image is produced by combining Achromatic Component Addition technique and well known dithering techniques for depositing drops of chromatic ink and achromatic ink (e.g. cyan 46 and white 43, for example) on a predetermined area 42 on paper 37.

It should be appreciated that the number of color levels is limited not by the ACA technique, rather only by the print application, the choice of print medium, and the throughput of the printer. For example, the absorption capacity of the print medium may determine the maximum number of ink drops to be placed on a given pixel. Also, to produce an acceptable printed image, an imaging application may require more color levels than a business graphics application, thus the change in the number of necessary ink drops.

It should be noted that: the use of any specific color or ink combination is for illustrative purposes only and that the invention can be applied to any other color and ink combination; Achromatic Component Addition technique is not limited to on-board ink reservoirs and that it can also be used with off-board (remote ink reservoir) ink-jet printing systems; and that the number of ink drops, the ink drop volume, and the order of ink deposit is a matter of design. The apparatus employed in using Achromatic Component Addition technique can be expanded to cover other embodiments. Examples of different embodiments include: Use of inks with colors other than cyan, magenta, and yellow; a single print cartridge having four separate ink reservoirs for storing: cyan (C), magenta (M), yellow (Y), and white (W) inks, and a print cartridge containing a fifth ink, black (K); using four individual print cartridges each having a different ink: cyan, yellow, magenta, and white, using five different print cartridges each having a different ink: cyan, yellow, magenta, white, and black; and any other inkjet printer or cartridge design.

Although, specific embodiments of the invention have been described and illustrated, the invention is not to be limited to the specific forms or arrangement of parts so described and illustrated. The invention is limited only by the claims.

What is claimed is:

1. A method for generating an improved-quality printed image on a printing medium comprising the steps of:

providing a printing medium comprising a plurality of ink-receiving pixels thereon;

depositing at least one drop of achromatic ink selected from the group consisting of black ink and white ink in at least one of said pixels;

depositing at least one drop of chromatic ink at least partially on top of said drop of achromatic ink; and depositing at least one additional drop of achromatic ink selected from the group consisting of black ink and white ink at least partially on top of said drop of chromatic ink in order to form a multi-ink product.

2. A method for generating an improved-quality printed image on a printing medium comprising the steps of:

providing a printing medium comprising a plurality of ink-receiving pixels thereon;

depositing at least one drop of chromatic ink in at least one of said pixels;

depositing at least one drop of achromatic ink selected from the group consisting of black ink and white ink at least partially on top of said drop of chromatic ink; and depositing at least one additional drop of chromatic ink at least partially on top of said drop of achromatic ink in order to form a multi-ink product.

3. A method for generating an improved-quality printed image on a printing medium comprising the steps of:

providing a printing medium comprising a plurality of ink-receiving pixels thereon;

grouping said pixels together to form a matrix;

depositing a plurality of ink drops at least partially on top of each other in at least one of said pixels in said matrix, said plurality of ink drops comprising at least one drop of chromatic ink and at least one drop of achromatic ink selected from the group consisting of black ink and white ink in order to form a multi-ink product; and leaving all of said pixels other than said at least one of said pixels having said multi-ink product therein blank and in an unprinted state in order to form a super pixel.

* * * * *